US012262750B2

(12) United States Patent
Qiu et al.

(10) Patent No.: US 12,262,750 B2
(45) Date of Patent: Apr. 1, 2025

(54) ATOMIZER AND AEROSOL GENERATING DEVICE WITH SAME

(71) Applicant: CHANGZHOU PATENT ELECTRONIC TECHNOLOGY CO., LTD, Changzhou (CN)

(72) Inventors: Weihua Qiu, Jiangsu (CN); Guanyun Shi, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 377 days.

(21) Appl. No.: 17/812,729

(22) Filed: Jul. 15, 2022

(65) Prior Publication Data

US 2022/0346455 A1 Nov. 3, 2022

Related U.S. Application Data

(63) Continuation-in-part of application No. PCT/CN2021/072180, filed on Jan. 15, 2021.

(30) Foreign Application Priority Data

Jan. 17, 2020 (CN) ..... 202020111358.2

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/46* (2020.01); *A24F 40/51* (2020.01)

(58) Field of Classification Search
None
See application file for complete search history.

(56) References Cited

U.S. PATENT DOCUMENTS

2017/0265524 A1 9/2017 Cadieux et al.
2018/0043114 A1* 2/2018 Bowen ..... A24F 40/65
(Continued)

FOREIGN PATENT DOCUMENTS

CN 106235420 A * 12/2016 ..... A24F 40/40
CN 207040883 U 2/2018
(Continued)

OTHER PUBLICATIONS

Power Thesaurus: "Mechanical Housing synonyms—36 Words and Phrases for Mechanical Housing". accessed Sep. 21, 2024]. Retrieved from Internet <https://www.powerthesaurus.org/mechanical_housing/synonyms>. (Year: 2024).*
(Continued)

*Primary Examiner* — Manley L Cummins, IV
(74) *Attorney, Agent, or Firm* — Andrew C. Cheng

(57) ABSTRACT

An atomizer includes a liquid storage member, an air guiding member and a bottom seat arranged between the liquid storage member and the air guiding member, wherein an atomizing chamber is provided in the atomizer, an air guiding groove in communication with the atomizing chamber is provided on the liquid storage member, and an air inlet channel in communication with the air guiding groove is provided on the air guiding member.

16 Claims, 6 Drawing Sheets

(51) Int. Cl.

| | |
|---|---|
| ***A24F 40/42*** | (2020.01) |
| ***A24F 40/46*** | (2020.01) |
| ***A24F 40/51*** | (2020.01) |

(56) References Cited

U.S. PATENT DOCUMENTS

| | | | | |
|---|---|---|---|---|
| 2018/0360121 | A1* | 12/2018 | Jiang | A24F 40/485 |
| 2019/0297949 | A1 | 10/2019 | Mironov | |

FOREIGN PATENT DOCUMENTS

| | | | |
|---|---|---|---|
| CN | 207040891 | U | 2/2018 |
| CN | 207885665 | U | 9/2018 |
| CN | 208002106 | U | 10/2018 |
| CN | 208425527 | U | 1/2019 |
| CN | 208550032 | U | 3/2019 |
| CN | 110051040 | A | 7/2019 |
| CN | 209546930 | U | 10/2019 |
| CN | 209694060 | U | 11/2019 |
| CN | 211672453 | U | 10/2020 |
| IN | 109315839 | A | 2/2019 |
| RS | 57009 | B1 | 5/2018 |
| RU | 2646554 | C2 | 3/2018 |

OTHER PUBLICATIONS

English Translation of CN 106235420 A (Year: 2016).*

The extended European search report of EP patent application No. 21741594.2 issued on Mar. 19, 2024.

International Search Report of PCT Patent Application No. PCT/CN2021/072180 issued on Apr. 19, 2021.

* cited by examiner

ATOMIZER AND AEROSOL GENERATING DEVICE WITH SAME

CROSS-REFERENCE TO RELATED APPLICATIONS

The present disclosure is a continuation-in-part of International Patent Application No. PCT/CN2021/072180, filed on Jan. 15, 2021, which claims priority to Chinese Patent Application No. 202020111358.2, filed on Jan. 17, 2020. All of the aforementioned patent applications are hereby incorporated by reference in their entireties.

TECHNICAL FIELD

This disclosure relates to the technical field of simulated smoking, and in particular to an atomizer and an aerosol generating device having the same.

BACKGROUND

The aerosol generating device includes an atomizer and a power supply device electrically connected to the atomizer. The atomizer is provided with a bottom seat and an atomizing cavity, the bottom seat is provided with an airway structure communicating with the atomizing cavity, so that the smoke generated in the atomizer enters the atomizing cavity through the airway structure, and then flows into the user's mouth. At present, the aerosol generating devices on the market are becoming smaller, the appearance is becoming thinner, and the inside available space is becoming less. During the production process, when the airway structure is formed on the bottom seat, the processing of other parts on the bottom seat is affected, and the production difficulty of the aerosol generating device is increased.

SUMMARY

Based on this, it is necessary to provide an atomizer and an aerosol generating device with an air channel structure that is convenient for production and processing.

The technical solution adopted by the present disclosure to solve the technical problem is: an atomizer includes a liquid storage member, an air guiding member, and a bottom seat located between the liquid storage member and the air guiding member, wherein an atomizing chamber is provided in the atomizer, an air guiding groove communicating with the atomizing chamber is provided on the liquid storage member, an air inlet channel communicating with the air guiding groove is provided on the air guiding member.

Further, the air inlet channel includes an air inlet opening and an air vent opening which are provided at an outer peripheral wall of the air guiding member and communicate with each other, external air enters the air inlet channel from the air inlet opening and flows to a lower end of the air guiding groove from the air vent opening.

Further, an included angle between a central axis of the air inlet opening and a central axis of the air vent opening is 90°.

Further, the number of the air inlet opening and the air vent opening is one, respectively.

Further, one end surface of the air guiding member near the bottom seat is recessed to form the air inlet channel, opposite ends of the air inlet channel extend respectively to the outer peripheral wall of the air guiding member, the air inlet opening is formed by one end of the air inlet channel, the air vent opening is formed by the other end of the air inlet channel.

Further, the air guiding groove is provided on a side wall of the liquid storage member.

Further, the atomizer includes a connecting member, the connecting member is located at one end of the bottom seat away from the air guiding member, the atomizing chamber is formed by, an inner cavity of the connecting member, the connecting member is provided with an air vent passage in a radial direction thereof, one end of the air vent passage communicates with the atomizing chamber, and the other end of the air vent passage communicates with an upper end of the air guiding groove.

Further, the atomizer includes a heating structure, the heating structure is mounted on the bottom seat and partially received in the atomizing chamber.

An aerosol generating device includes the atomizer described above.

Further, the aerosol generating device includes an outer housing and a sensor disposed in the outer housing, the outer housing is provided with an accommodating chamber therein, the sensor is received in the accommodating chamber, the air guiding member is provided with a through hole communicating with the air inlet channel, the through hole communicates with the accommodating chamber.

The beneficial effects of the present disclosure are: in the atomizer or aerosol generating device provided by the present disclosure, the air guiding groove communicating with the atomization cavity is provided on the liquid storage member, and the air inlet channel is provided on the air guiding member, so that the external air can enter the atomizing chamber through the air inlet channel and the air guiding groove. It is avoided to directly form an air channel structure on the bottom seat in order to communicate with the atomizing chamber, thereby reducing the difficulty of production and processing of the atomizer, and the structure is simple and suitable for widespread use.

BRIEF DESCRIPTION OF THE DRAWINGS

The following describes the present disclosure further with reference to the drawings and embodiments.

Figure 1:
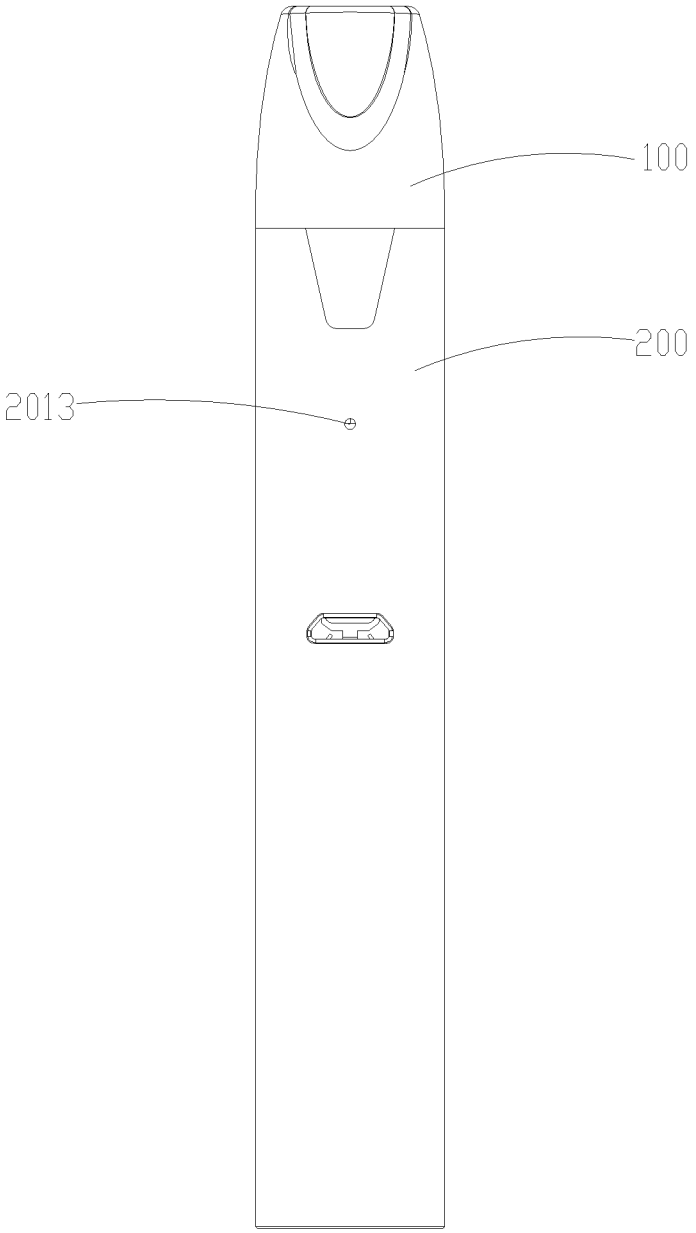
FIG. 1 is a schematic diagram of the aerosol generating device of the present disclosure.

The part names and reference signs thereof in the drawings are as follows:

| | | |
|---|---|---|
| atomizer 100 | liquid storage member 10 | bottom seat 20 |
| connecting member 30 | heating structure 40 | air guiding member 50 |

-continued

| | | |
|---|---|---|
| air outlet opening 121 | vent tube 12 | air guiding groove 14 |
| mounting protrusion 21 | mounting hole 22 | accommodating groove 23 |
| electrode 60 | atomizing chamber 31 | air vent hole 32 |
| penetrating hole 54 | first sealing member 34 | air vent passage 35 |
| liquid inlet hole 36 | second sealing member 37 | heating member 41 |
| liquid storage chamber 13 | pin 411 | air inlet channel 51 |
| air inlet passage 52 | air inlet opening 511 | air vent opening 512 |
| through hole 513 | power supply device 200 | outer housing 201 |
| battery cell 202 | sensor 203 | circuit board 204 |
| casing 2011 | end cover 2012 | air inlet hole 2013 |
| sealing flange 53 | mounting bracket 2014 | accommodating chamber 2015 |
| mounting chamber 2016 | communication hole 2017 | sensor sealing member 2031 |
| receiving groove 24 | first magnetic member 26 | placement groove 2018 |
| second magnetic member 2019 | lampshade 205 | connecting hole 122 |
| base body 25 | latching block 251 | main body 38 |
| mounting flange 39 | connecting protrusion 391 | engaging groove 392 |
| latching groove 381 | engaging protrusion 371 | |

DETAILED DESCRIPTION OF PREFERRED EMBODIMENTS

The present disclosure will now be described in detail with reference to the drawings. These drawings are simplified schematic diagrams, which only illustrate the basic structure of the present disclosure in a schematic manner, and only show the structure related to the present disclosure.

Figure 2:
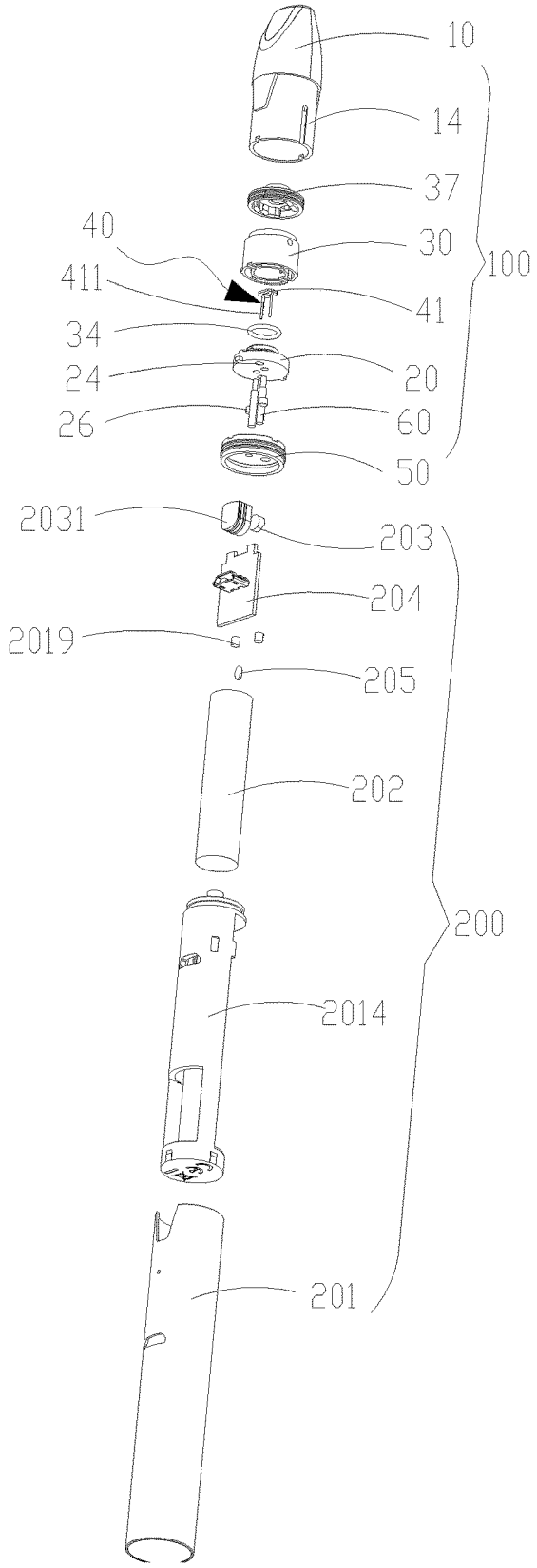
FIG. 2 is an exploded view of the aerosol generating device shown in FIG. 1.
Figure 3:
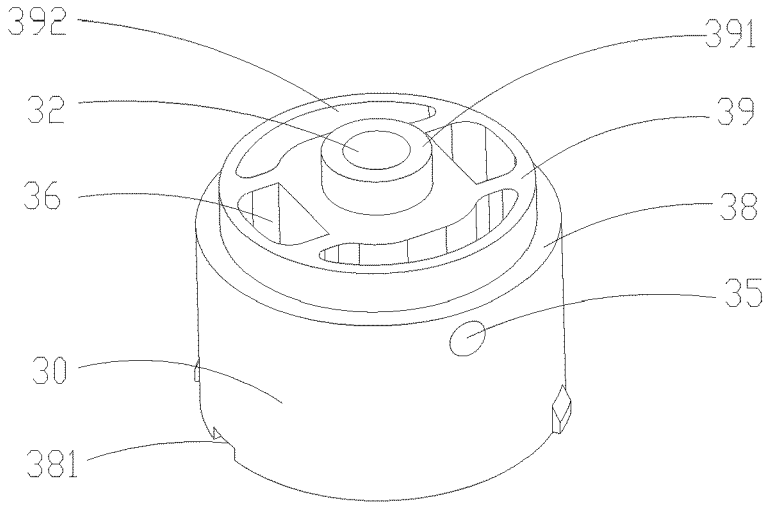
FIG. 3 is a schematic diagram of the connecting member of the aerosol generating device shown in FIG. 2.

As shown in FIG. 1 and FIG. 2, the present disclosure provides an aerosol generating device, the aerosol generating device includes an atomizer 100 and a power supply device 200 electrically connected to the atomizer 100. The atomizer 100 includes a liquid storage member 10, a bottom seat 20 disposed at one end of the liquid storage member 10, a connecting member 30 and a heating structure 40 disposed on the bottom seat 20, and an air guiding member 50 disposed at one end of the bottom seat 20. In use, the aerosol-forming substrate in the liquid storage member 10 enters the heating structure 40, the power supply device 200 supplies power to the heating structure 40, and the heating structure 40 atomizes the aerosol-forming substrate to generate smoke for the user to inhale.

Figure 6:
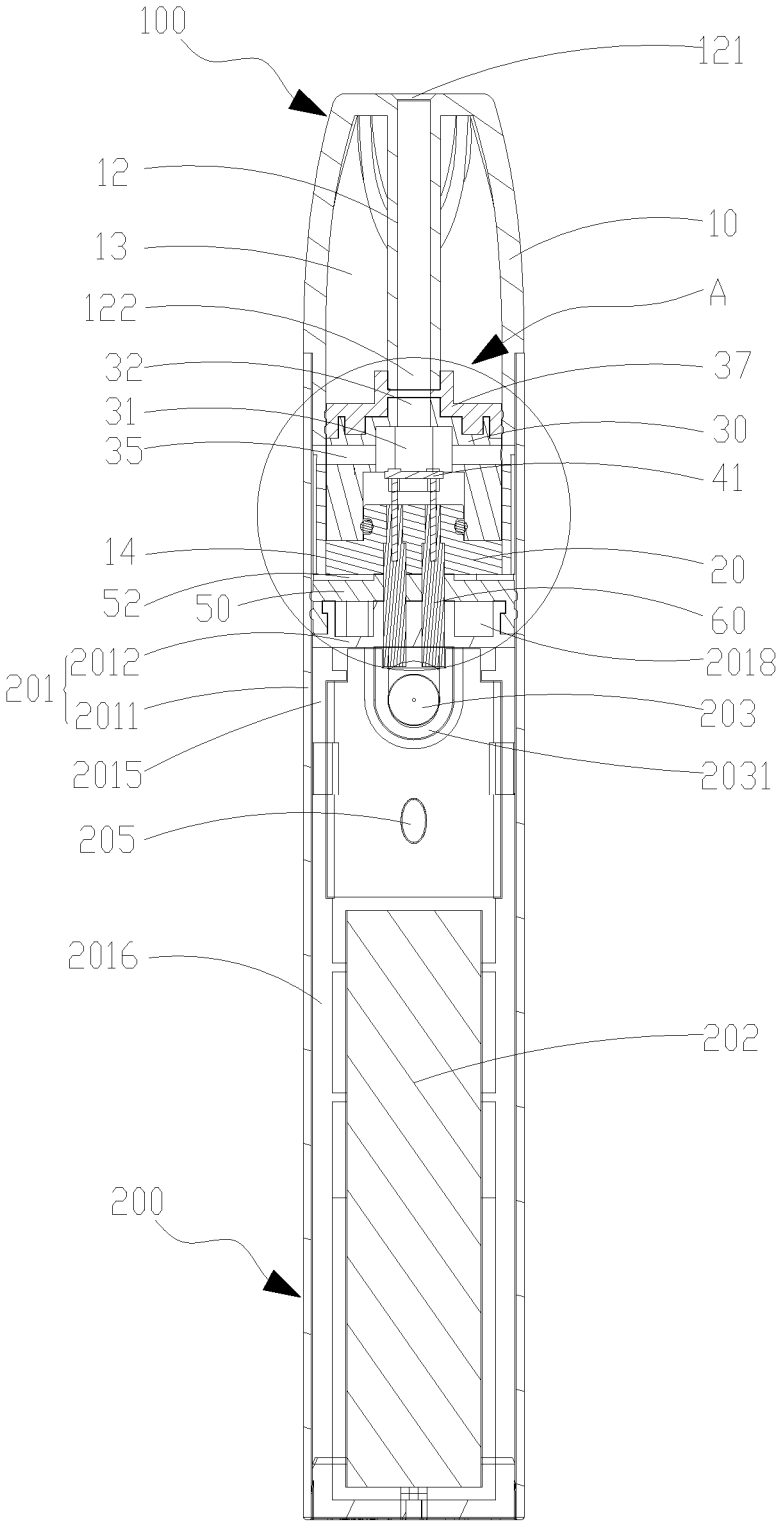
FIG. 6 is a cross-sectional view of the aerosol generating device shown in FIG. 1.

As shown in FIG. 2 and FIG. 6, the liquid storage member 10 has a hollow cylindrical structure, one end of the liquid storage member 10 forms an open end, a vent tube 12 is provided in the liquid storage member 10, the vent tube 12 has a hollow cylindrical shape, the opposite ends of the vent tube 12 are both open. The upper end of the vent tube 12 extends through the liquid storage member 10 and is opened to form an air outlet opening 121. The lower end of the vent tube 12 is opened to form a connecting hole 122. The space between the inner wall of the liquid storage member 10 and the outer wall of the vent tube 12 forms a liquid storage chamber 13 for storing the aerosol-forming substrate. Air guiding grooves 14 are formed and recessed on the outer surface of the side wall of the liquid storage member 10 at opposite sides. Each air guiding groove 14 is elongated and extends along the axial direction of the liquid storage member 10.

Figure 4:
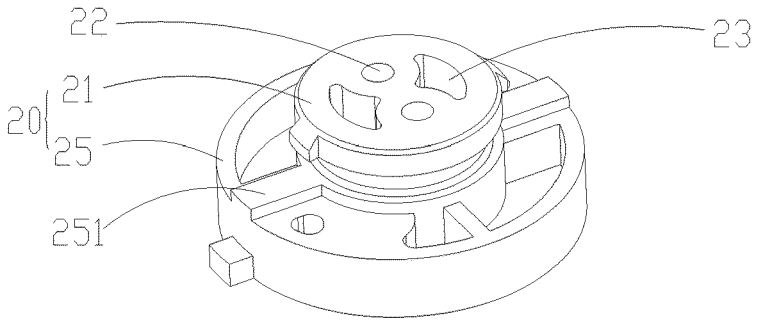
FIG. 4 is a schematic diagram of the bottom seat of the aerosol generating device shown in FIG. 2.
Figure 5:
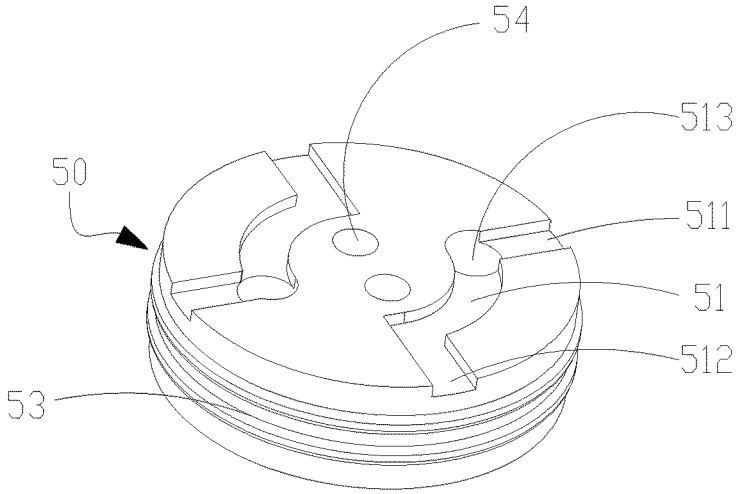
FIG. 5 is a schematic diagram of the air guiding member of the aerosol generating device shown in FIG. 2.

As shown in FIG. 4 and FIG. 6, the bottom seat 20 includes a base body 25 and a mounting protrusion 21 protruding from one end of the base body 25. The base body 25 is provided with latching blocks 251 at opposite sides of the mounting protrusion 21. The mounting protrusion 21 is provided with two oppositely arranged mounting holes 22 and two oppositely arranged accommodating grooves 23. The connecting line between the centers of the two mounting holes 22 intersects with the connecting line between the centers of the two accommodating grooves 23. The bottom seat 20 is received in the open end of the liquid storage member 10. The atomizer 100 further includes two electrodes 60, each electrode 60 corresponds to a mounting hole 22. Each electrode 60 is received in the corresponding mounting hole 22 at the bottom seat 20.

As shown in FIG. 3, FIG. 6, FIG. 7 and FIG. 8, the connecting member 30 is substantially cylindrical. The connecting member 30 is received in the open end of the liquid storage member 10 and located above the bottom seat 20. The connecting member 30 includes a main body 38 and a mounting flange 39 provided on the main body 38. The center of the mounting flange 39 is provided with a connecting protrusion 391. The mounting flange 39 is recessed to form liquid inlet holes 36 at two opposite sides of the connecting protrusion 391. The mounting flange 39 is recessed to form engaging grooves 392 at the other two opposite sides of the connecting protrusion 391. The connecting protrusion 391 is provided with an air vent hole 32 communicating with the atomizing chamber 31. The main body 38 is recessed to form an atomizing chamber 31 at the end away from the mounting flange 39. The main body 38 is recessed to form latching grooves 381 corresponding to the latching blocks 251 at the opposite sides of the atomizing chamber 31. The main body 38 is provided with an air vent passage 35 in the radial direction. One end of the air vent passage 35 is in communication with the atomizing chamber 31, the other end of the air vent passage 35 is in communication with the air guiding groove 14. The connecting protrusion 391 is connected to the vent tube 12, so that the atomizing chamber 31, the air vent hole 32, the connecting hole 122, the inner cavity of the vent tube 12 and the air outlet opening 121 are connected in sequence. Meanwhile, the aerosol-forming substrate in the liquid storage chamber 13 can flow into the atomizing chamber 31 via the liquid inlet holes 36. One end of the main body 38 away from the mounting flange 39 is sleeved on the mounting protrusion 21 of the bottom seat 20, the mounting protrusion 21 is received in the atomizing chamber 31, the latching block 251 is received in the latching groove 381. A first sealing member 34 is sandwiched between the outer wall of the mounting protrusion 21 and the inner wall of the atomizing chamber 31. The first sealing member 34 is made of a sealing material such as silicone or rubber, so as to enhance the sealing performance between the connecting member 30 and the bottom seat 20.

In one embodiment, a second sealing member 37 is further provided on the connecting member 30, the second sealing member 37 is provided with engaging protrusions 371, the engaging protrusions 371 correspond to the engaging grooves 392. One end of the second sealing member 37 is sleeved at the connection between the vent tube 12 and the connecting protrusion 391, the other end of the second sealing member 37 is sleeved on the connecting member 30. The engaging protrusions 371 are fitted into the corresponding engaging grooves 392. It can be understood that the second sealing member 37 is made of a sealing material such as silicone or rubber, so as to enhance the sealing performance between the connecting member 30 and the vent tube 12.

The heating structure 40 includes a heating member 41 and a liquid absorbing member (not shown) in contact with each other, the heating member 41 is a heating body that can be energized to generate heat. The liquid absorbing member has the function of absorbing the aerosol-forming substrate. One end of the liquid absorbing member is received in the accommodating groove 23, the other end of the liquid absorbing member is received in the atomizing chamber 31. That is, the heating structure 40 is partially received in the atomizing chamber 31. The heating member 41 is arranged on the liquid absorbing member. Both ends of the heating member 41 are respectively connected with pins 411, and the pin 411 extends through the liquid absorbing member and is received in the mounting hole 22 to contact and electrically connect with the electrode 60. It can be understood that the liquid absorbing member is a porous liquid absorbing member, and the liquid absorbing member can be one, two or more combinations of cotton, porous ceramics, fiber rope, foamed metal, and foamed graphite. In this embodiment, the liquid absorbing member is cotton. The heating member 41 can be a heating member that is energized to generate heat, such as a heating tube, a heating sheet, or a heating rod. In this embodiment, the heating member 41 is a heating sheet, and the heating member 41 and the pins 411 are integrally formed.

As shown in FIGS. 5-8, the air guiding member 50 is substantially cylindrical, the outer peripheral wall of the air guiding member 50 is provided with a sealing flange 53, and a penetrating hole 54 is provided near the center of the air guiding member 50. One end surface of the air guiding member 50 is recessed to form two air inlet channels 51. The two air inlet channels 51 are arranged at opposite sides of the penetrating hole 54. In this embodiment, the number of the penetrating hole 54 is two. It can be understood that, in other embodiments not shown, the number of the penetrating hole 54 can also be one. The opposite ends of each air inlet channel 51 extend to the outer peripheral wall of the air guiding member 50 respectively, one end of the air inlet channel 51 forms an air inlet opening 511, the other end of the air inlet channel 51 forms an air vent opening 512. That is, the air inlet opening 511 and the air vent opening 512 are provided at the outer peripheral wall of the air guiding member 50 and communicate with each other. The bottom wall of the air inlet channel 51 is further provided with a through hole 513. The air guiding member 50 is arranged at one end of the liquid storage member 10. The air guiding member 50 is located outside the liquid storage member 10 and below the bottom seat 20. The upper end surface of the air guiding member 50 abuts against the lower end surface of the bottom seat 20, the bottom wall of the bottom seat 20 and the groove wall of each air inlet channel 51 are jointly enclosed to form an air inlet passage 52, the air inlet opening 511 communicates with the air inlet passage 52 and outside environment, the air vent opening 512 corresponds to one of the air guiding grooves 14. Each air vent opening 512 is in communication with the corresponding air guiding groove 14, so that the external air can enter the air inlet passage 52 through the air inlet opening 511, and then flow into the air guiding groove 14 via the air vent opening 512. In this embodiment, the air inlet channel 51 is an arc-shaped groove, so as to facilitate the air flowing from the air inlet opening 511 to the air vent opening 512. The included angle between the central axis of the air inlet opening 511 and the central axis of the air vent opening 512 is 90°. The number of the air inlet opening 511 and the air vent opening 512 for each air inlet channel 51 is one, respectively. It can be understood that, in other embodiments not shown, the number of the air inlet opening 511 and the number of the air vent opening 512 for each air inlet channel 51 can be two or more, respectively.

Figure 8:
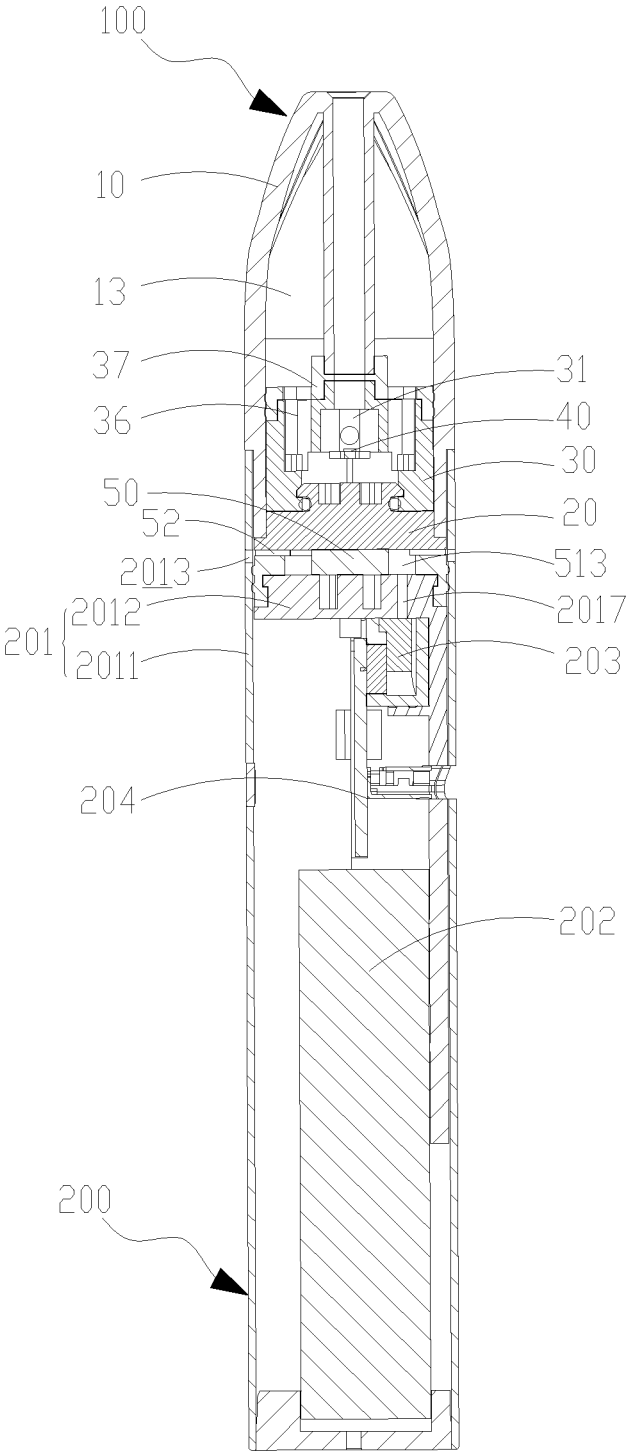
FIG. 8 is another cross-sectional view of the aerosol generating device shown in FIG. 1 (rotated by 90 degrees relative to FIG. 6).

As shown in FIG. 2, FIG. 6 and FIG. 8, the power supply device 200 includes an outer housing 201, and a battery cell 202, a sensor 203 and a circuit board 204 arranged in the outer housing 201.

Figure 7:
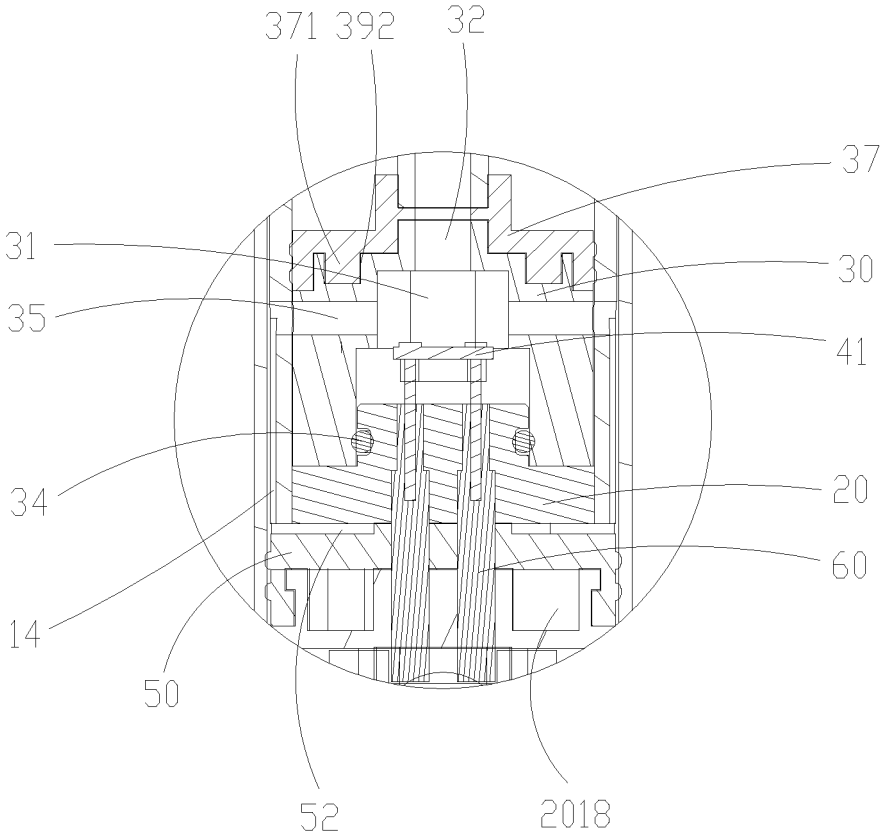
FIG. 7 is a partially enlarged view of part A in FIG. 6.

As shown in FIG. 1, FIG. 6 and FIG. 7, the outer housing 201 includes a casing 2011 and an end cover 2012 disposed at one end of the casing 2011. The casing 2011 is provided with two air inlet holes 2013. The upper end of the casing 2011 is sleeved on the lower end of the liquid storage member 10, the air guiding member 50 is received in the casing 2011, and the outer wall of the air guiding member 50 abuts against the inner wall of the casing 2011. The arrangement of the sealing flange 53 at the air guiding member 50 enhances the sealing performance between the air guiding member 50 and the casing 2011. Each air inlet hole 2013 is in communication with a corresponding air inlet opening 511. When the user inhales, the external air enters the air inlet passage 52 through the air inlet hole 2013 and the air inlet opening 511 in sequence, then enters the air guiding groove 14 through the air inlet passage 52, and finally enters the atomizing chamber 31 through the air guiding groove 14 and the air vent passage 35. Since the airflow in the aerosol generating device enters the air guiding groove 14 after it changes direction by 90° in the air inlet passage 52, the airflow has a longer air passage in the atomizer, which helps to heat the airflow, prevents the user from inhaling cold smoke, and improves the user's taste of inhaling.

A mounting bracket 2014 is provided in the casing 2011, the mounting bracket 2014 is provided with an accommodating chamber 2015 and a mounting chamber 2016 therein. The battery cell 201 and the circuit board 204 are received in the mounting chamber 2016. The sensor 203 is received in the accommodating chamber 2015. Both the battery cell 201 and the sensor 203 are electrically connected to the circuit board 204. The end cover 2012 is located at one end of the mounting bracket 2014 to close the accommodating chamber 2015. The end cover 2012 is provided with a communication hole 2017, and the communication hole 2017 is in communication with the accommodating chamber 2015 and the through hole 513. One end of the electrode 60 mounted on the bottom seat 20 extends through the mounting hole 2 and the penetrating hole 54 and is received in the end cover 2012, one of the electrodes 60 is electrically connected to the positive electrode of the battery cell 202, and the other electrode 60 is electrically connected to the negative electrode of the battery cell 202, so that the heating member 41 is electrically connected to the battery cell 202. When the user inhales the aerosol generating device, the gas in the accommodating chamber 2015 flows into the air inlet passage 52 via the communication hole 2017 and the through hole 513, so that a negative pressure is formed in the accommodating chamber 2015. When the sensor 203 detects that the air pressure in the accommodating chamber 2015 changes, the atomization circuit is triggered to be turned on, the battery cell 202 supplies power to the heating member 41 to enable the heating member 41 to work, and the temperature of the heating member 41 gradually increases. At the same time, the aerosol-forming substrate in the liquid storage chamber 13 enters the atomizing chamber 31 via the liquid inlet holes 36, and the liquid absorbing member absorbs the aerosol-forming substrate, the aerosol-forming substrate absorbed by the liquid absorbing member generates smoke under the heating action of the heating member 41, and under the suction effect of the user, the smoke enters the user's mouth via the atomizing chamber 31, the air vent hole 32 and the inner cavity of the vent tube 12 in sequence. In this embodiment, the sensor 203 is an air pressure sensor.

It can be understood that, in other embodiments not shown, the air inlet channel 51 can be separately provided in the air guiding member 50, or alternatively, the air inlet channel 51 can also be separately provided in the bottom seat 20, it only needs to satisfy that an air inlet channel communicating with the air guiding groove 14 is formed between the air guiding member 50 or/and the bottom seat 20.

In one embodiment, as shown in FIG. 6, a sensor sealing member 2031 is sleeved on the outside of the sensor 203, the sensor sealing member 2031 is configured to prevent other gases around the sensor 203 from flowing into the sensor 203 in order to improve the detection accuracy of the sensor 203.

In one embodiment, as shown in FIG. 2 and FIG. 6, the bottom of the bottom seat 20 is provided with a receiving groove 24, a first magnetic member 26 is received in the receiving groove 24. The top of the end cover 2012 is provided with a placement groove 2018, a second magnetic member 2019 matching with the first magnetic member 26 is received in the placement groove 2018. When the atomizer 100 and the power supply device 200 are assembled, the first magnetic member 26 and the second magnetic member 2019 are attracted to each other, so that the air guiding member 50 is sandwiched between the bottom seat 20 and the end cover 2012, not only the stability of the connection between the atomizer 100 and the power supply device 200 is enhanced, but also the sealing performance between the air guiding member 50 and the bottom seat 20 is enhanced.

In one embodiment, as shown in FIG. 6, an indicator light is provided in the outer housing 201, the indicator light is electrically connected to the battery cell 202. When the user activates the aerosol generating device, the indicator light illuminates. A lampshade 205 is provided on the side wall of the casing 2011, the lampshade 205 is used to protect the indicator light and prevent the indicator light from being damaged.

It can be understood that, in other embodiments not shown, the air guiding groove 14 can also be provided on the inner surface of the side wall of the liquid storage member 10, and the casing 2011 only needs to be sleeved on part of the air guiding member 50 so that the atomizer 100 and the power supply device 200 can be fixedly connected. At this time, the air inlet opening 511 directly communicates with the external air, and the external air enters the air inlet passage 52 through the air inlet opening 511.

In the atomizer 100 provided by the present disclosure, the air guiding groove 14 communicating with the atomization cavity 31 is provided on the liquid storage member 10, and the air inlet channel 51 is provided on the air guiding member 50, so that the external air can enter the atomizing chamber 31 through the air inlet channel 51 and the air guiding groove 14. It is avoided to directly form an air channel structure on the bottom seat 20 in order to communicate with the atomizing chamber 31, thereby reducing the difficulty of production and processing of the atomizer 100, and the structure is simple and suitable for widespread use.

Since the aerosol generating device provided by the present disclosure has all the technical features of the above atomizer 100, it has the same technical effects as the above atomizer 100.

Taking the above-mentioned ideal embodiments according to the present disclosure as enlightenment, through the above description, the relevant persons can make various changes and modifications without departing from the concept of the present disclosure. The technical scope of the present disclosure is not limited to the content of the specification, and its technical scope should be determined according to the scope of the claims.

What is claimed is:

1. An atomizer comprising a liquid storage member, an air guiding member, and a bottom seat located between the liquid storage member and the air guiding member, wherein an atomizing chamber is provided in the atomizer, an air guiding groove communicating with the atomizing chamber is provided on the liquid storage member, and an air inlet channel communicating with the air guiding groove is provided on the air guiding member;

the air inlet channel comprises an air inlet opening and an air vent opening which are provided at an outer peripheral wall of the air guiding member and communicate with each other, and external air enters the air inlet channel from the air inlet opening and flows out from the air vent opening;

one end surface of the air guiding member near the bottom seat is recessed to form the air inlet channel, opposite ends of the air inlet channel extend respectively to the outer peripheral wall of the air guiding member, the air inlet opening is formed by one end of the air inlet channel, and the air vent opening is formed by the other end of the air inlet channel; and the air guiding groove and the atomizing chamber are located above the air inlet channel, and the external air flowing out from the air vent opening flows upwards along the air guiding groove to enter the atomizing chamber.

2. The atomizer according to claim 1, wherein an included angle between a central axis of the air inlet opening and a central axis of the air vent opening is 90°.

3. The atomizer according to claim 1, wherein the number of the air inlet opening and the air vent opening is one, respectively.

4. The atomizer according to claim 1, wherein the air inlet channel is an arc-shaped groove.

5. The atomizer according to claim 1, wherein the air guiding groove is provided on a side wall of the liquid storage member.

6. The atomizer according to claim 5, wherein the air guiding groove is formed and recessed on an outer surface or an inner surface of the side wall of the liquid storage member.

7. The atomizer according to claim 5, wherein the air guiding groove is elongated and extends along an axial direction of the liquid storage member.

8. The atomizer according to claim 1, wherein the atomizer further comprises a connecting member, the connecting member is located at one end of the bottom seat away from the air guiding member, the atomizing chamber is formed by an inner cavity of the connecting member, the connecting member is provided with an air vent passage in a radial direction thereof, one end of the air vent passage communicates with the atomizing chamber, and the other end of the air vent passage communicates with the air guiding groove.

9. The atomizer according to claim 8, wherein the atomizer further comprises a heating structure, and the heating structure is mounted on the bottom seat and partially received in the atomizing chamber.

10. The atomizer according to claim 8, wherein a lower end of the liquid storage member forms an open end, the bottom seat is received in the open end of the liquid storage member, the connecting member is received in the open end of the liquid storage member and located above the bottom seat, and the air guiding member is located outside the liquid storage member and below the bottom seat.

11. The atomizer according to claim 10, wherein the bottom seat comprises a base body and a mounting protrusion protruding from one end of the base body, the connecting member comprises a main body, and one end of the main body near the bottom seat is sleeved on the mounting protrusion of the bottom seat.

12. The atomizer according to claim 10, wherein an upper end surface of the air guiding member abuts against a lower end surface of the bottom seat, a bottom wall of the bottom seat and a groove wall of the air inlet channel are jointly enclosed to form an air inlet passage, the air inlet opening communicates with the air inlet passage and outside environment, and the air vent opening communicates with the air inlet passage and the air guiding groove.

13. An aerosol generating device comprising the atomizer according to claim 1.

14. The aerosol generating device according to claim 13, wherein the aerosol generating device further comprises an outer housing and a sensor disposed in the outer housing, the outer housing is provided with an accommodating chamber therein, the sensor is received in the accommodating chamber, the air guiding member is provided with a through hole communicating with the air inlet channel, and the through hole communicates with the accommodating chamber.

15. The aerosol generating device according to claim 14, wherein the outer housing comprises a casing and an end cover disposed at one end of the casing, the air guiding member is received in the casing, and an outer wall of the air guiding member abuts against an inner wall of the casing.

16. The aerosol generating device according to claim 15, wherein a bottom of the bottom seat is provided with a receiving groove, a first magnetic member is received in the receiving groove, a top of the end cover is provided with a placement groove, a second magnetic member matching with the first magnetic member is received in the placement groove, and the first magnetic member and the second magnetic member are attracted to each other to sandwich the air guiding member between the bottom seat and the end cover.

* * * * *